United States Patent [19]

Ford

[11] Patent Number: 4,776,500

[45] Date of Patent: Oct. 11, 1988

[54] THERAPEUTIC DENTIFRICE DISPENSER

[76] Inventor: Christopher W. Ford, 80 Briarcliff, Grosse Pointe Shores, Mich. 48236

[21] Appl. No.: 501,892

[22] Filed: Jun. 7, 1983

[51] Int. Cl.[4] ..... B65D 83/00

[52] U.S. Cl. ..... 222/402.1; 222/402.12; 424/53

[58] Field of Search ..... 424/53; 222/402.1, 402.15, 222/402.13, 402.12

[56] References Cited

U.S. PATENT DOCUMENTS

| | | | |
|---|---|---|---|
| 2,765,965 | 10/1956 | Reswick | 222/402.21 |
| 3,146,916 | 9/1964 | Kronheim | 222/402.13 |
| 3,497,110 | 2/1970 | Bombero et al. | 222/402.13 |
| 4,374,823 | 2/1983 | Harvey et al. | 424/52 |

*Primary Examiner*—Joseph J. Rolla

*Attorney, Agent, or Firm*—Harness, Dickey & Pierce

[57] ABSTRACT

A dentifrice dispenser is described which generally comprises a pressurizable container, a predetermined dentifrice composition disposed in the container, a valve controlling the discharge of the dentifrice from the container, and a propellant disposed in the container for causing the discharge of the dentifrice from the container upon actuation of the valve. The dentifrice is preferably a therapeutic toothpaste which includes a predetermined composition of hydrogen peroxide, baking soda and salt in amounts which are effective in treating periodontal infections. A removable nozzle for directing the discharge of the therapeutic toothpaste from the container is also provided.

7 Claims, 1 Drawing Sheet

THERAPEUTIC DENTIFRICE DISPENSER

BACKGROUND AND SUMMARY OF THE INVENTION

The present invention relates generally to dentifrice dispensers, and particularly to dispensers for therapeutic dentifrices or oral compositions used to treat periodontal diseases.

Periodontal diseases are diseases which affect the tissues surrounding and supporting the teeth, i.e., the gums and adjacent bones. Periodontal diseases come in various classifications from gingival inflamation to sulcus bleeding, pocket formation and bone loss. These periodontal diseases are believed to be caused by bacteria which accumulate and proliferate on and around the teeth. While most oral hygiene measures, such as toothbrushing, are directed at cleaning the teeth, apparent cleanliness does not always ensure adequate control of bacterial growth.

While surgery has been widely used to treat severe periodontal infections, a conservative non-surgical alternative for treating periodontal infections has been gaining increasing recognition in recent years. These alternatives are discussed in an article entitled "A Periodontist's View On Surgical And Non-Surgical Therapy" by Paul M. Cummings, Jr., which was published in the Annotations from The International Dental Health Foundation, June 1982, Volume 2, No. 2. The non-surgical or antibacterial treatment for controlling periodontal infections is set forth in detail in an article entitled "Measures To Aid In The Prevention And Control Of Dental Carries And Periodontal Diseases" by Paul H. Keyes, which was published in the Annotations from the International Dental Health Foundation, Jan. 1982, Volume 1, Number.

An important part of this non-surgical treatment involves the brushing of teeth in the following manner. First, the toothbrush is dipped into a solution of 3% hydrogen peroxide (about one cap full) and table salt (about 0.25 teaspoon full). Water may also be added to the solution in an amount equal to the amount of hydrogen peroxide. Then, the moistened bristles are dipped into baking soda (sodium bicarbonate), such that some of the baking soda will adhere to the bristles of the toothbrush. This mixture is then smeared along the gingival margins, and subsequently the teeth are gently and carefully brushed with the toothbrush.

The above-identified non-surgical procedure is intended to be performed by the patient at home twice daily until the infection is cured. Then, a maintenance phase begins in which the procedure is performed once a day to keep bacteria under control. It should be noted that while hydrogen peroxide, baking soda and salt are all bactericidal adjuvants, the oxygen from the hydrogen peroxide is particularly effective in attacking the type of bacteria which causes periodontal lesions. Additionally, the baking soda and the salt also operate to draw fluid out of the cells of the tissues which are infected.

It should be appreciated from the above that the toothbrushing part of the non-surgical therapy is not only time consuming, but also requires that separate supplies of hydrogen peroxide, baking soda and salt must be maintained. Additionally, a dish and a spoon or the like must be available in order to mix these adjuvants together. Furthermore, the patient must endure the unpalatable taste of this mixture once or twice a day.

The patient must also take care to ensure that the cap to the hydrogen peroxide bottle is securely tightened after each use, because the oxygen in the hydrogen peroxide will gradually disassociate and reduce the effectiveness of the hydrogen peroxide in combating bacteria.

A principal objective of the present invention is to simplify and reduce the amount of time involved in an antibacterial therapy for treating periodontal diseases.

Another objective of the present invention is to provide a dentifrice or oral composition which includes a combination of adjuvants for treating periodontal diseases.

It is a more specific objective of the present invention to provide a therapeutic dentifrice or oral composition which includes a predetermined mixture of hydrogen peroxide, baking soda and salt.

It is an additional objective of the present invention to provide a dispenser containing a predetermined dentrifice or oral composition.

It is a more specific objective of the present invention to provide a dispenser containing a therapeutic dentrifice or oral composition which includes a predetermined mixture of hydrogen peroxide, baking soda and salt.

It is yet another objective of the preset invention to provide a dispenser containing a therapeutic dentifrice or oral composition will encourage patients to use an antibacterial therapy for treating periodontal diseases.

It is still another objective of the present invention to provide a dentifrice dispenser which is tamper resistant.

To achieve the foregoing objectives, the present invention provides a dentifrice dispenser, which generally comprises a pressurizable container, a predetermined dentifrice composition disposed in the container, a valve controlling the discharge of the dentifrice from the container, and a propellant disposed in the container for causing the discharge of the dentifrice from the container upon actuation of the valve. The dentifrice is preferably a therapeutic toothpaste which includes a predetermined composition of hydrogen peroxide, baking soda and salt. A removable nozzle for directing the discharge of the therapeutic toothpaste from the container is also provided.

Additional advantages and features of the present invention will become apparent from a reading of the detailed description of the preferred embodiments which makes reference to the following set of drawings in which:

DETAILED DESCRIPTION OF THE PREFERRED EMBODIMENTS

Figure 1:
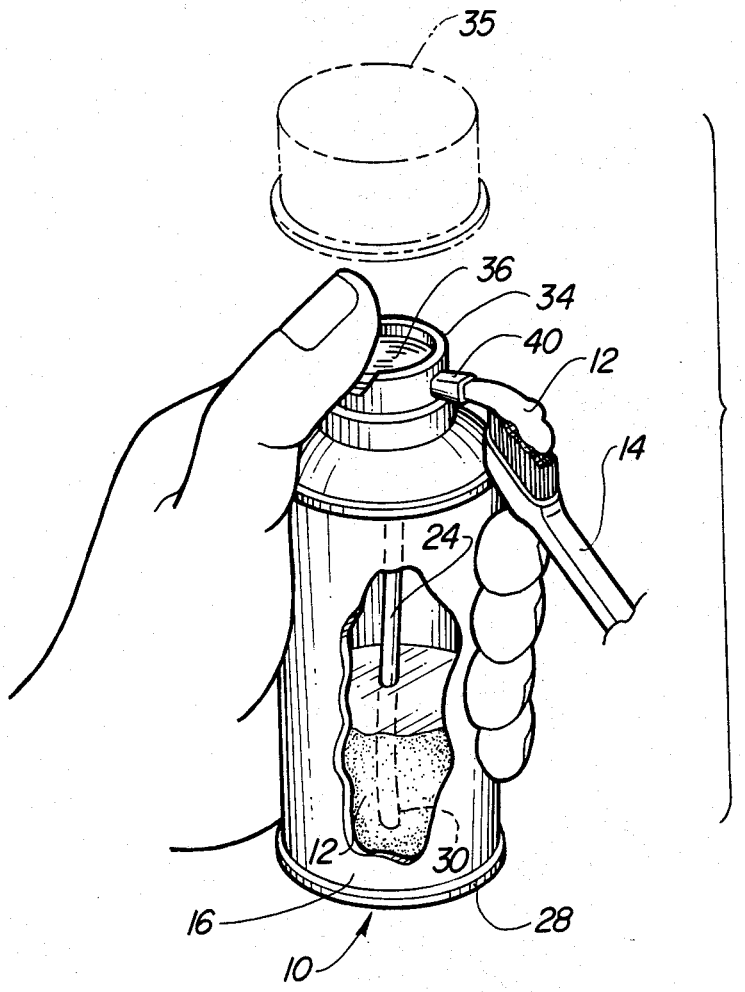
FIG. 1 is a perspective view of a dispenser according to the present invention, which is being utilized to dispense a dentifrice or oral composition according to the present invention.

Referring to FIG. 1, a dentifrice dispenser 10 according to the present invention is shown in the process of dispensing a dentifrice 12 upon a toothbrush 14. While the dispenser 10 may be used to dispense a variety of dentifrices or oral compositions, it is particularly advantageous to provide a dispenser which contains a therapeutic toothpaste having a predetermined composition in accordance with the present invention.

Figure 2:
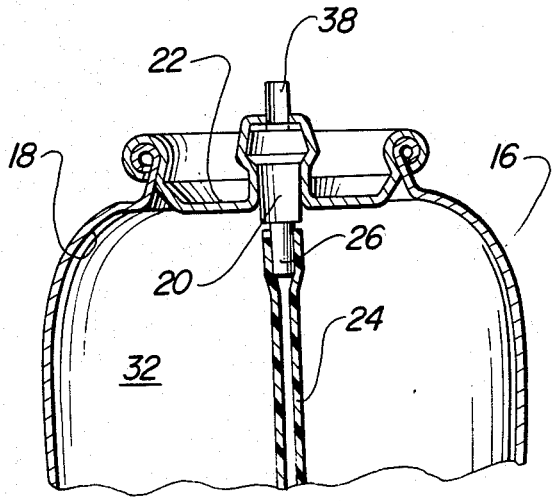
FIG. 2 is a cross-sectional view of the dispenser shown in FIG. 1.

Referring to both FIGS. 1 and 2, the dispenser 10 includes a hermetically sealed container 16 which provides an internal chamber 18 for containing a supply of the dentifrice 12. The container 16 may be of any suitable shape and construction which will permit the container to be internally pressurized. The dispenser also includes a manually actuable valve 20 for controlling the discharge of the dentifrice 12 from the internal chamber 18 of the container 16. The valve 20 is centrally mounted in a fluid-tight seal to a top wall portion 22 of the container 16. A dip tube 24 is secured in a press fit relationship to the internal port 26 of the valve 20. The dip tube 24 extends downwardly from the valve 20 in a generally vertical direction and terminates near to a bottom wall portion 28 of the container 16. The dip tube 24 is provided with a lower opening 30 for permitting flow of the dentifrice 12 through the dip tube.

The dispenser 10 also includes a gaseous propellant disposed within an upper portion 32 of the internal chamber 18 of the container 18 for causing the discharge of the dentifrice 12 from the container upon the actuation of the valve 20. While this propellant is preferably compressed air, other suitable propellants may also be used in the appropriate application. It should be appreciated that the choice of a propellant must be such that it will not contaminate or adversely affect the dentifrice 12 with which it will come into contact inside the container 16.

The dispenser 10 also includes a plastic valve cover 34 which is adapted to snap onto the container 16 over the valve 20, and a plastic top cover which is adapted to snap onto the container over the valve cover. As is conventional in the art, the valve cover 34 includes a central disc portion 36 which seats upon the external port 38 of the valve 20. The disc portion 36 of the valve cover 34 is connected to a spout portion 40 of the valve cover via a tube portion which is adapted to convey the dentifrice 12 exiting the valve 20 to the spout portion. Accordingly, in order to discharge the dentifrice 12 from the container 16, the user need only depress the disc portion 36 of the valve cover 34, and the dentifrice 12 will be dispensed out from the spout portion 40 by virtue of the propellant contained in the container 16.

Figure 3:
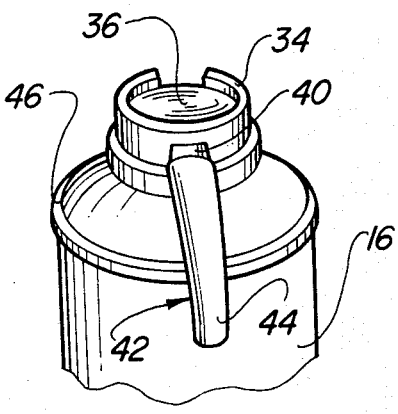
FIG. 3 is a partial perspective view of the dispenser shown in FIG. 1 which particularly illustrates a removable nozzle according to the present invention.

As shown in FIG. 3, the dispenser 10 further includes a nozzle 42 which is adapted to be removably secured to the spout portion 40 of the valve cover 34 via a press fit or snap-on connection. The nozzle 42 is generally comprised of a tube portion 44 which has a curved, decreasing diameter and an integral ring portion 46 which is adapted to retain the nozzle in association with the dispenser 10 when the nozzle is not secured to the valve cover 34. The ring portion 46 may be formed to snap over a lip or snap into a groove provided in the valve cover 34. With this construction, the nozzle may be completely detached from the valve cover in order to be cleaned or replaced. The nozzle 42 is preferably made from a resilient plastic or elastomeric material which is inert to the dentifrice 12.

The nozzle 42 is advantageously used to direct the discharge of the dentifrice 12 from the container 16. Specifically, the nozzle 42 enables a user to apply the dentifrice 12 directy to the oral cavity. Fo example, as part of an antibacterial therapy to combat periodontitis, the patient will be able to inject the therapeutic dentifrice directly into periodontal lesions and pockets before a toothbrushing procedure is commenced.

In accordance with the present invention, the dentifrice 12 of the dispenser 10 is preferably a therapeutic toothpaste which is useful in combating bacteria in the oral cavity, particularly the type of bacteria believed to be responsible for causing periodontal infections. Specifically, the therapeutic toothpaste should include an oxidizing agent, a carbonate compound and an alkaline earth metal salt in amounts which are effective to fight bacteria in the oral cavity. More specifically, it is preferred that the oxidizing agent be a peroxide compound, such as 3% hydrogen peroxide. Similarly, it is preferred that the carbonate compound be baking soda (sodium bicarbonate), and it is preferred that the alkaline earth metal salt be table salt (sodium chloride). However, it should be noted that Epsom salt (magnesium sulfate) may be more preferable than table salt for persons on a low sodium diet.

It should be noted that commercially available toothpaste or gel compositions may be employed as a base to a therapeutic toothpaste in accordance with the present invention. However, other suitable toothpaste or gel formulations may also be utilized. Such toothpaste formulations may include, for example, an abrasive material, a flourine-containing compound, a binder material and a sweetening agent. To either such commercially available compositions or other formulations, the therapeutic adjuvants hydrogen peroxide, baking soda and salt may be added and dissolved therein.

Preferably, the therapeutic toothpaste will include from about 1.0% to about 30.0% of hydrogen peroxide, from about 1.0% to about 10.0% baking soda, and from about 1.0% to about 10% salt. More preferably, the therapeutic toothpaste will include from about 20.0% to about 30.0% of hydrogen peroxide, from about 5.0% to about 10.0% of baking soda, and from about 5.0% to about 10.0% of salt. Most preferably, the therapeutic toothpaste will include approximately 25% hydrogen peroxide, approximately 7% baking soda, and approximately 7% salt. The above percentages are percentages by weight of the respective adjuvants in a therapeutic toothpaste composition.

With respect to combining the therapeutic adjuvants in a toothpaste composition, it should be noted that it may be advisable to pre-mix the baking soda with a portion of the hydrogen peroxide and separately pre-mix the salt with a portion of the hydrogen peroxide to ensure that the baking soda and the table salt are completely dissolved. Thus, for example, a quarter teaspooon of baking soda is mixed with a tablespoon of 3% hydrogen peroxide in one dish, while a quarter teaspoon of salt is mixed with a tablespoon of 3% hydrogen peroxide in another dish. After the baking soda and table salt are dissolved, the two dishes are combined and mixed. Then, this mixture is combined and thoroughly mixed in a one ounce commercially available toothpaste composition.

With regard to charging the dispenser 10, it is preferred that the dentifrice 12 be introduced into the container 16 before the container is pressurized. While the dentifrice 12 may be introduced into the container 16 before the container is hermetically sealed, such as before the top wall portion 22 is secured to the container, it is preferred that the container be assembled prior to the introduction of the dentifrice. In the situation where the container 16 has been previously assembled, the dentifrice may be injected into the container through the valve 20. Prior to this injection step, it should be noted that it may be advantageous to first evacuate the container 16 to facilitate the introduction of the dentifrice 12 into the container. After an appropriate supply of the dentifrice 12 has been introduced into the container 61, the container may then be pressurized with a suitable propellant. This propellant, such as compressed air, may also be introduced into the container via the external port 38 of the valve 20.

It should be noted that an important feature of the dispenser 10 is that the dentifrice 12 is continuously kept under pressure until the dentifrice is applied to the toothbrush 14 or directly applied to the oral cavity. This feature is particularly advantageous when a therapeutic dentifrice is employed which contains hydrogen peroxide ($H_2O_2$). With a pressurized container, the tendancy of the oxygen molecules in the hydrogen peroxide to disassociate from the hydrogen molecules will be substantially suppressed or eliminated. Accordingly, the complete effectiveness of the hydrogen peroxide will be ensured over extended periods of time.

Additionally, it should be appreciated that the dispenser 10 according to the present invention will also provide a method of storing a supply of the dentifrice 12 which is also tamper resistant. Furthermore, no increase in effort need be expended by the user to discharge substantially all of the dentifrice 12 from the dispenser 10, as is required with a conventional toothpaste tube which must be squeezed and properly rolled or otherwise compressed at various times by the user. It should also be appreciated that the dispenser 10 according to the present invention also eliminates the need for a screw-on cap, as required by conventional toothpaste tubes, which must be removed one or more times per day and which may be easily lost or forgotten.

Another advantage of the present invention is that it substantially reduces the amount of time and effort involved for a patient employing an antibacterial therapy to combat a periodontal infection. There is no longer a necessity to maintain separate supplies of the therapeutic adjuvants and mix them in the proper proportions in order to perform the toothbrushing portion of the therapy. Additionally, since the therapeutic toothpaste or gel will also include a flavoring or sweetening agent, the taste of the therapeutic adjuvants will be substantially enhanced, and this flavor enhancement should operate to encourage patients to use the antibacterial therapy.

It will be appreciated that the above disclosed embodiment is well calculated to achieve the aforementioned objectives of the present invention. In addition, it is evident that those skilled in the art, once given the benefit of the foregoing disclosure, may now make modifications of the specific embodiment described herein without departing from the spirit of the present invention. Such modifications are to be considered within the scope of the present invention which is limited solely by the scope and spirit of the appended claims.

I claim:

1. A therapeutic toothpaste dispenser, comprising:

a hermetically sealed container which is capable of being pressurized;

a supply of a therapeutic toothpaste disposed within said container, said toothpaste including an effective amount of a predetermined composition of hydrogen peroxide, sodium bicarbonate and sodium chloride;

a valve associated with said container for controlling the discharge of said toothpaste from said container; and a propellant disposed within said container for causing the discharge of said toothpaste from said container upon the actuation of said valve.

2. The therapeutic toothpaste dispenser according to claim 1, wherein said toothpaste includes from about 1.0% to about 30.0% hydrogen peroxide.

3. The therapeutic toothpaste dispenser according to claim 2, wherein said toothpaste includes from about 1.0% to about 10.0% sodium bicarbonate.

4. The therapeutic toothpaste dispenser according to claim 3, wherein said toothpaste includes from about 1.0% to about 10.0% sodium chloride.

5. The therapeutic toothpaste dispenser according to claim 4, wherein said toothpaste also includes an abrasive material, a fluorine-containing compound, a binder material and a sweetening agent.

6. The therapeutic toothpaste dispenser according to claim 1, further including nozzle means removably secured to said valve for directing the discharge of said toothpaste from said container.

7. The therapeutic toothpaste dispenser according to claim 6, wherein said nozzle means is made from a resilient material.

* * * * *